US005232554A

United States Patent [19]

Kotitschke

[11] Patent Number: 5,232,554

[45] Date of Patent: Aug. 3, 1993

[54] THREADING THE WEB INTO A TWIN WIRE DRYER GROUP

[75] Inventor: Gerhard Kotitschke, Steinheim, Fed. Rep. of Germany

[73] Assignee: J.M. Voith GmbH, Fed. Rep. of Germany

[21] Appl. No.: 793,827

[22] Filed: Nov. 18, 1991

[30] Foreign Application Priority Data

Nov. 27, 1990 [DE] Fed. Rep. of Germany ..... 4037661

[51] Int. Cl.[5] ..... D21F 7/00

[52] U.S. Cl. ..... 162/193; 162/255; 162/286; 34/117

[58] Field of Search ..... 162/193, 255, 200, 286, 162/273; 34/116, 117, 118, 120

[56] References Cited

U.S. PATENT DOCUMENTS

| | | | |
|---|---|---|---|
| 4,543,160 | 9/1985 | Kerttula et al. | 162/193 |
| 4,648,942 | 3/1987 | Wanke et al. | 162/286 |
| 4,677,763 | 7/1987 | Kotitschke et al. | 34/117 |
| 4,809,445 | 3/1989 | Meyer et al. | 34/117 |
| 4,893,741 | 1/1990 | Heinzmann | 34/117 |
| 4,934,067 | 6/1990 | Wedel | 34/41 |
| 4,945,655 | 8/1990 | Wedel | 34/23 |
| 4,972,608 | 11/1990 | Ilvespää | 34/117 |

FOREIGN PATENT DOCUMENTS 8300514 2/1983 World Int. Prop. O. .

*Primary Examiner*—Peter Chin
*Assistant Examiner*—Dean Tan Nguyen
*Attorney, Agent, or Firm*—Ostrolenk, Faber, Gerb & Soffen

[57] ABSTRACT

The dry end of a paper making machine includes a twin wire dryer group following a single wire dryer group. The paper web is continuously guided by a support belt which moves alternately between dryer cylinders and intermediate deflecting rolls in the single wire dryer group. In the twin wire dryer group, the web travels over open lengths between dryer cylinders in the two rows of the second group. A rope guide threads the web into the twin wire dryer group. The start of the rope guide, called the rope shears, is in the vicinity of the periphery of the last or next to last deflecting roll called the selected deflecting roll in the single wire dryer group. Between the selected deflecting roll at the start of the rope shears and the preceding selected dryer cylinder, there is a relatively long straight path of travel for the support belt. Parallel to that path, there is a scraper and a guide plate which deflects the edge strip of the web laterally into the rope shears which is laterally to the side of the web. The rope guide then threads the web into the second dryer group.

27 Claims, 4 Drawing Sheets

THREADING THE WEB INTO A TWIN WIRE DRYER GROUP

BACKGROUND OF THE INVENTION

The present invention relates to a dry end of a machine for the manufacture of a fiber web, and particularly a paper web. The dry end has a single wire dryer group followed by a twin wire dryer group. Such a dry end is part of a paper manufacturing machine which was placed in operation in 1989.

The present invention is concerned with threading the web to be dried into the dry end. In a known threading technique the mechanically dewatered web which is formed in the initial part of the paper manufacturing machine, i.e. in the wire and press sections, travels during the initial phase and usually already at its full intended operating speed, provisionally only up to the outlet end of the press section. From there, the web enters a broke pulper. While this is occurring, a narrow edge strip is cut from the web and is transferred into the dry end. When the leading tip or tail of the edge strip has reached the outlet end of the dry end, the edge strip is gradually widened until it reaches the full width of the web.

The known dry end includes at least one single wire dryer group in which the web travels together with a support belt, for instance, a dryer wire, alternately over dryer cylinders and deflecting rolls. In such a single wire dryer group, the web and thus also the leading tip of the edge strip travels over the dryer cylinders between the outer surfaces of the cylinders and the support belt, while over the deflecting rolls, the web travels on the outside of the support belt. In the region of the deflecting rolls, the web, including the leading tip of the edge strip, is held fast against the support belt by a vacuum in or at the deflecting rolls. However, special edge suction chambers can be provided in the deflecting rolls for holding the edge strip to those rolls. Furthermore, it is known to provide blast nozzles which contribute to guiding the leading tip of the edge strip.

After traveling through the single wire dryer group, the web enters a following twin wire dryer group. There the web travels alternately over upper and lower dryer cylinders arranged in respective upper and lower rows. The web is pressed by an upper support belt against all of the upper dryer cylinders and by a lower support belt against all of the lower dryer cylinders. On the path from an upper cylinder to the next lower cylinder and then to the next upper cylinder, the web travels a distance over which the web is free of any support belt and therefore the web travels in a so called open web length.

A rope guide for threading the tip of the edge strip is provided here, laterally outside the width of the web. This guide comprises two ropes which, along the same path as the web, travel alternately over the upper and lower dryer cylinders. The two ropes form a so called rope shears at the beginning of the twin wire dryer group. There the two ropes converge toward each other so that they can grasp the tip of the edge strip and transport it further. Shortly before or upstream of the rope shears, with respect to the direction of travel of the web, a deflection device deflects the leading tip of the edge strip from the lateral region of the width of the web laterally outward into the rope shears.

In the known dry end, the transfer from the last dryer cylinder of the single wire dryer group to the first dryer cylinder of the twin wire dryer group is developed similarly to the transfer shown in FIG. 1 of published International Application WO 83/00514, noting the two dryer cylinders 14 and 26. In practice, however, the first open length of the web between these two dryer cylinders is shortened in that the last deflecting roll 19 of the single wire dryer group and the first deflecting roll 28 of the twin wire dryer group are arranged at a relatively short distance apart. This is desirable in normal operation for dependable guidance of the web. This arrangement, however, has the following disadvantage. Since the rope shears is arranged in the vicinity of the point at which the web runs onto the first dryer cylinder of the twin wire dryer group, the above described deflection of the tip of the edge strip must be effected within a relatively short open length of the web. This affords difficulties, although a scraper having a guide plate, and which can be developed approximately in accordance with German Published Patent Application 39 41 242.3, is provided on the last dryer cylinder of the single wire dryer group for guiding the edge strip.

SUMMARY OF THE INVENTION

The object of the present invention is to develop a dry end of this type so that the transfer of the edge strip from the single wire group to the twin wire dryer group occurs with greater dependability than previously and occurs completely automatically even at very high speeds of operation, i.e. on the order of 1500 to 2000 meters per minute.

The dry end of a paper making machine which includes the invention includes a twin wire dryer group following a single wire dryer group. In the single wire dryer group, the paper web is continuously guided by a support belt which moves between successive dryer cylinders and intermediate deflecting rolls. In the twin wire dryer group, the web travels over open lengths between a dryer cylinder in one row and the next dryer cylinder in the path of the web in the other row.

A rope guide threads the web into the twin wire dryer group. The start of the rope guide, called the rope shears, is in the vicinity of the periphery of a selected deflecting roll that is the last or the next to last deflecting roll in the single wire dryer group. Between the selected deflecting roll at the start of the rope shears and the preceding selected dryer cylinder, there is a relatively long straight path of travel for the support belt. Extending parallel to that straight path, there is a scraper at the preceding dryer cylinder for assuring that the web separates from that dryer cylinder and there is a guide plate which is oriented to deflect the edge strip of the web laterally into the rope shears which is laterally to the side of the web. The rope guide then threads the web into the twin wire dryer group.

The rope shears for holding the leading tip of the edge strip of the web being threaded into the twin wire dryer group is located laterally outside the width of the web. The leading tip of the edge strip must be deflected laterally to the rope shears. For this purpose, the guide plate is oriented to direct the leading tip of the edge strip laterally over to the rope shears. The guide plate is located on the somewhat elongate straight path of travel between the selected preceding dryer cylinder and the selected following deflection roll near which the rope shears is formed. The guide plate may be associated with a scraper which will scrape the dryer cylinder to assure that the edge strip is separated from the dryer cylinder and that the web may move along the straight path to the rope shears. The rope shears is arranged in the region of the periphery of the selected deflecting roll either directly at its periphery or even a small distance after it. The guide plate for deflecting the leading tip of the edge strip to the rope shears preferably extends approximately parallel to the straight path of travel between the dryer cylinder and the deflecting roll where the rope shears is formed.

In the invention, the lateral deflection of the leading tip of the edge strip into the rope shears takes place, at least predominantly, not within an open or unsupported length of the web but within a relatively long straight section of the path of travel of the web while the web is still being completely guided by the support belt of the single wire dryer group. A similar configuration is known from U.S. Pat. No. 4,648,942. In that case, however, the rope shears is arranged in the initial region of a single wire dryer group since the rope guide there is used exclusively for the threading of the edge strip into the single wire dryer group. On the other hand, the present invention proceeds from a dry end in which the single wire dryer group does not require a rope guide. The concept of the present invention resides in shifting the rope shears of a rope guide of a twin wire dryer group such a distance in the direction into the single wire dryer group preceding it that the support belt of the single wire dryer group, together with other auxiliary means still to be described, substantially supports the lateral deflection of the leading tip of the edge strip into the rope shears. It is particularly advantageous to develop the invention such that the rope shears itself also lies within the end region of the single wire dryer group. In this way, the rope guide can guide the leading tip of the edge strip also over the open length of the web between the single wire group and the twin wire dryer group insofar as there is such an open length present.

The length of the straight path of travel of the web and the support belt in front or upstream of the rope shears depends on the distance between the so called rope plane and the edge of the width of the web and therefore on how far the edge strip must be deflected laterally outward. In particular, the length of the straight path of travel of the support belt between the selected dryer cylinder preceding the rope shears and the selected deflecting roll in the vicinity of the rope shears is generally in the range of two to ten times and preferably in the range of three to six times the lateral distance of the rope guide from the edge of the web width, and the edge strip of the web is guided over that lateral distance to the rope shears by the guide plate which deflects it.

The lateral deflection of the leading tip of the edge strip out of the normal path is brought about, as previously, primarily by the scraper and by the corresponding guide plate having a pneumatic deflection means. However, in the invention, the guide plate is arranged as parallel as possible to the relatively long straight travel path of the support belt, which path usually extends from the selected cylinder of the single wire dryer group to the selected following deflecting roll. Therefore, a relatively narrow channel which is as long as possible is formed between the guide plate of the scraper and the support belt, preferably not over the entire width of the web but only in the region of the edge strip. The guide plate is developed, for instance, in accordance with German application P 39 41 242.3.

If the leading tip of the edge strip is first detached by the scraper from the dryer cylinder during the start up phase of the operation of the paper making machine, it will be deflected through the channel and, by means of obliquely outward directed blast air channels or similar, preferably pneumatic, deflection means of the guide plate, it will be dependably deflected into the rope shears. Because the channel is relatively narrow, movement of the leading tip of the edge strip in an undesired direction can be prevented with a high degree of certainty. The pneumatic deflection device is generally activated only during the threading of the edge strip.

Other objects and features of the invention are described below with reference to the drawings.

BRIEF DESCRIPTION OF THE PREFERRED EMBODIMENTS

FIG. 1 is a diagrammatic side view of a part of a dry end of a paper making machine.

FIG. 2 also shows a side view of another similar embodiment of a dry end.

DETAILED DESCRIPTION OF THE INVENTION

Figure 1:
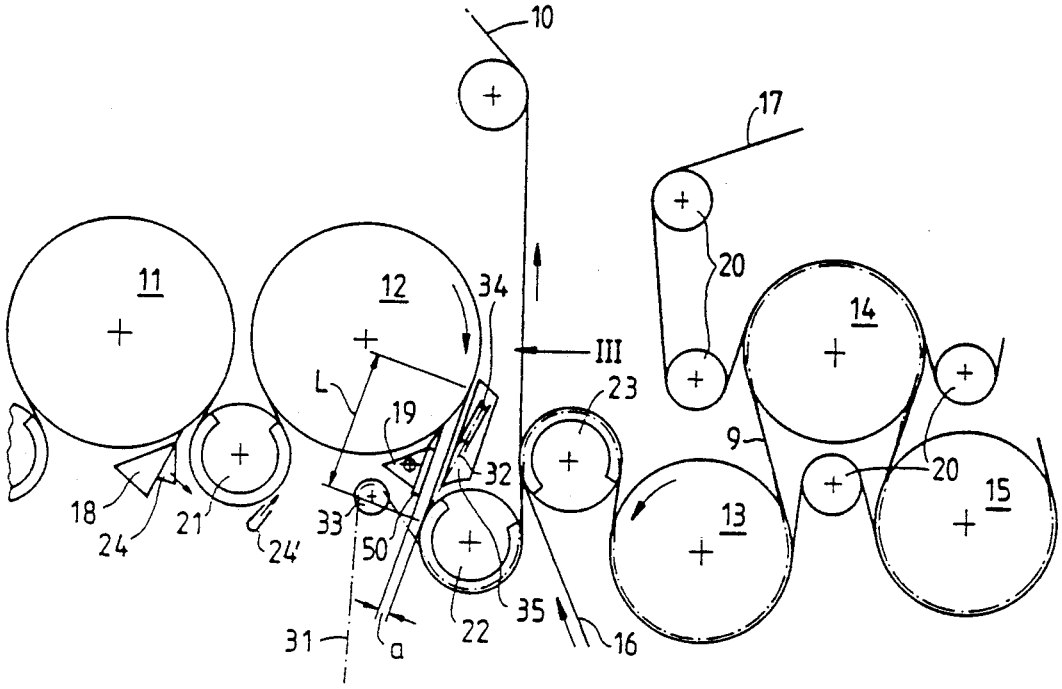

FIG. 1 shows the two last dryer cylinders 11 and 12 of a single wire dryer group and the first three dryer cylinders 13, 14 and 15 of a following twin wire dryer group of the dry end of a paper making machine. A web of paper 9 which is to be dried is conducted in a customary manner by means of a web support belt 10 through the single wire dryer group with the web 9 on that side of the belt 10 that the web comes into direct contact with the dryer cylinders 11 and 12. After passing each of the dryer cylinders 11, 12, the web 9 and the support belt 10 travel over a respective deflecting roll 21, 22. These are developed as suction guide rolls. In FIG. 1, the deflecting rolls 21, 22 each lie below the adjacent dryer cylinders 11, 12, so that in each case the upper region of the dryer cylinders 11, 12 is wrapped by the web 9 and the support belt 10.

In the following twin wire dryer group, the first dryer cylinder 13 is in the lower row of dryer cylinders. A lower web support belt 16 travels over the lower row. The second dryer cylinder 14 is in the upper row of dryer cylinders. An upper web support belt 17 travels over the upper row. The web 9 travels in a meandering path back and forth between the lower and upper rows of cylinders. There are open, i.e. unsupported, lengths of web between every two cylinders along the web path through the twin wire dryer group. The lower support belt 16 first travels over a take up roll 23 which is developed as a suction guide roll and which takes up the web from the support belt 10. Thereafter, normal guide rolls 20 are provided for guiding the support belts 16 and 17, as is customary.

On the lower regions of the dryer cylinders 11, 12 in the first dryer group, that is their regions which are free of the web, there are scrapers 18, 19, respectively, which serve, inter alia, upon start up of the paper making machine for detaching the tip of the edge strip from the outer surface of the respective cylinder. Air blast means 24, 24' may be provided on the deflecting roll 21 for holding the tip of the edge strip fast on the support belt 10 by means of air jets. As an alternative, an edge suction chamber may be provided within the deflecting roll 21.

The scraper 19 for the cylinder 12 is provided with a guide plate 50. Details of that plate are described further below with reference to FIG. 3. The guide plate 50 extends substantially parallel to the relatively long straight travel path of the web 9 and the support belt 10 between a selected dryer cylinder 12 and a selected deflecting roll 22, i.e. into the region of the below described rope shears. This straight path of travel has the length L. The guide plate 50 preferably extends up into the vicinity of the place where the support belt 10 travels onto the selected deflecting roll 22, i.e. into the region of the below described rope shears. The distance a between the guide plate 50 and the web 9 or the support belt 10 is relatively small (on the order of 50 to 200 mm). The guide plate 50 need not be an additional structural part. It can also be formed by the scraper body 40 itself as shown in FIG. 3.

Outside the lateral width of the web, the twin wire dryer group has a rope guide with two endless ropes 31 and 32. The start of the rope guide, the so called rope shears, is arranged not in the twin wire dryer group, but instead on the selected, in FIG. 1 the last, deflecting roll 22 of the single wire dryer group. FIG. 1 shows only two of the rope pulleys 33 and 34 which guide the ropes 31 and 32 to the deflecting roll 22. As shown in dash-dot lines, the ropes 31, 32 then travel jointly from the deflecting roll 22 to the deflecting roll 23 at the start of the twin wire dryer group and from there over the second dryer cylinders 13, 14 and 15 and therefore the ropes at all times travel along the path of travel of the paper web 9, then over further dryer cylinders (not shown) and finally back to the rope pulleys 33, 34.

Figure 3:
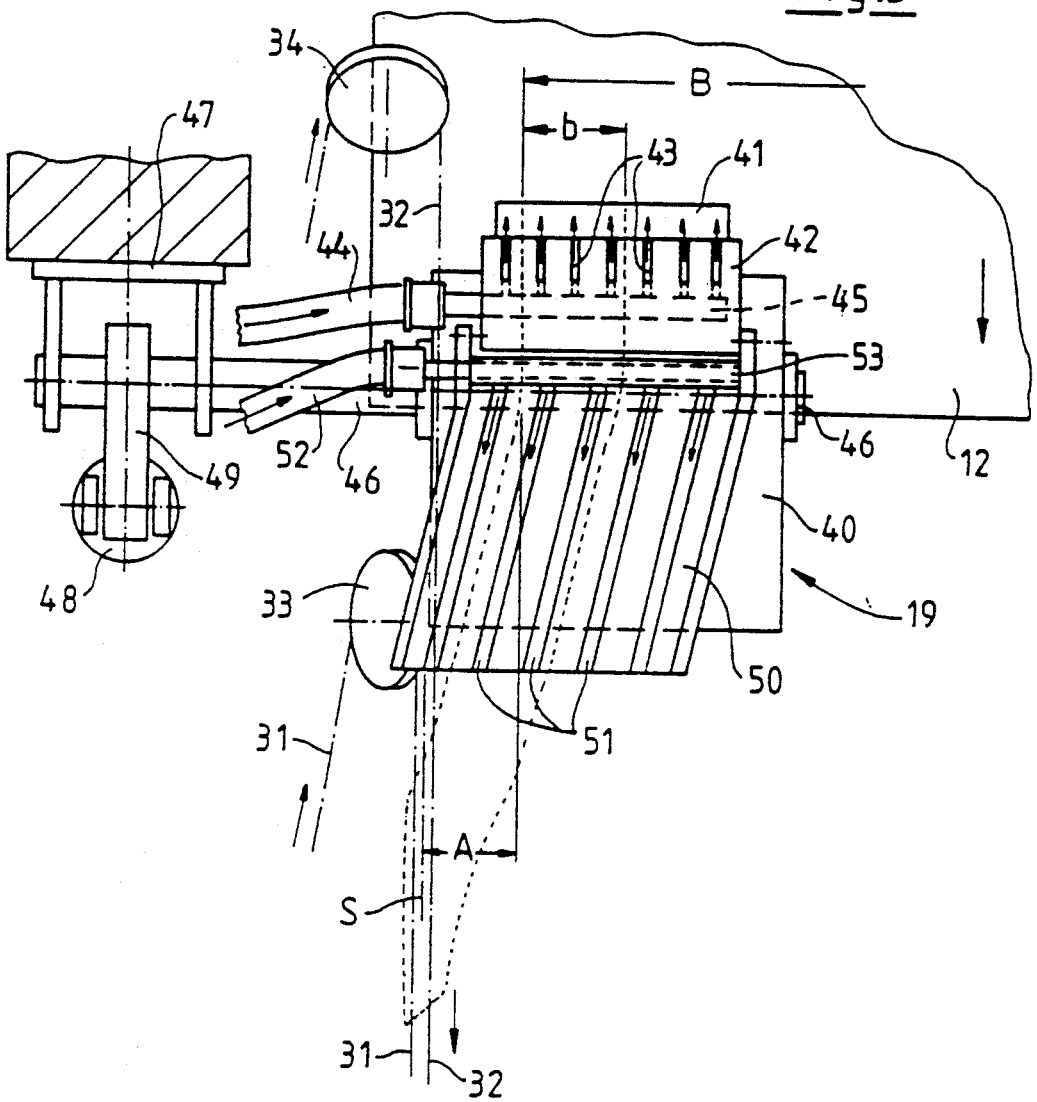
FIG. 3 is a partial view seen in the direction of the arrow III in FIG. 1.

FIG. 3 shows a scraper body 40 of the scraper 19. A scraper blade 41 is attached to the body 40 by means of a clamping piece 42 and rests against the wall of the dryer cylinder 12. The clamping piece 42 has air guidance grooves 43, which are supplied with blast air via a blast air feed channel 44, 45. The blast air detaches the oncoming or leading tip of the edge strip from the scraper blade 41 or, even before reaching the blade, from the wall of the dryer cylinder 12. The scraper body 40 is seated on a support rod 46 which is turnably mounted in a support 47. A hydraulic cylinder 48 is connected via a swing lever 49 to the support rod 46 so that by turning of the scraper body 40, the scraper blade 41 can be lifted off the cylinder 12. FIG. 3 shows a relatively short scraper, which serves only for further guiding the edge strip and is therefore arranged on the operator end side of the dryer cylinder 12. As an alternative, the scraper body and the scraper blade 41 may also extend over the entire width of the web. As a further alternative, an additional scraper 54 may be provided for the entire width of the web behind or after the scraper body 40 in the direction of rotation of the dryer cylinder 12, as shown, for instance, in FIG. 6.

According to FIG. 3, a guide plate 50 is arranged on the scraper body 40. The plate 50 extends obliquely laterally outward with respect to the direction of travel of the web and also has obliquely laterally outwardly extending air guide grooves 51. They are supplied with blast air via a blast air feed channel 52, 53.

The entire paper web has the width B in FIG. 3 defined between the lateral edges of the web. The lateral edge strip, which serves for threading the paper web, has the width b. A dot dash line shows how the leading tip of the edge strip is deflected laterally outward beyond the edge of widths B and b by the guide plate 50 so that the leading tip of the strip only can be grasped by the rope shears between the ropes 31, 32 which are guided by their rope pulleys. The distance A of the ropes 31, 32, more precisely called the rope plane S, from the edge of the web width B determines the required length L (FIG. 1) of the linear path of travel of web 9 and support belt 10. In general, the length L should be in the range of two to ten times the distance A, and preferably in the range of three to six times the distance A beyond the neighboring lateral edge of web widths B and b.

Figure 2:
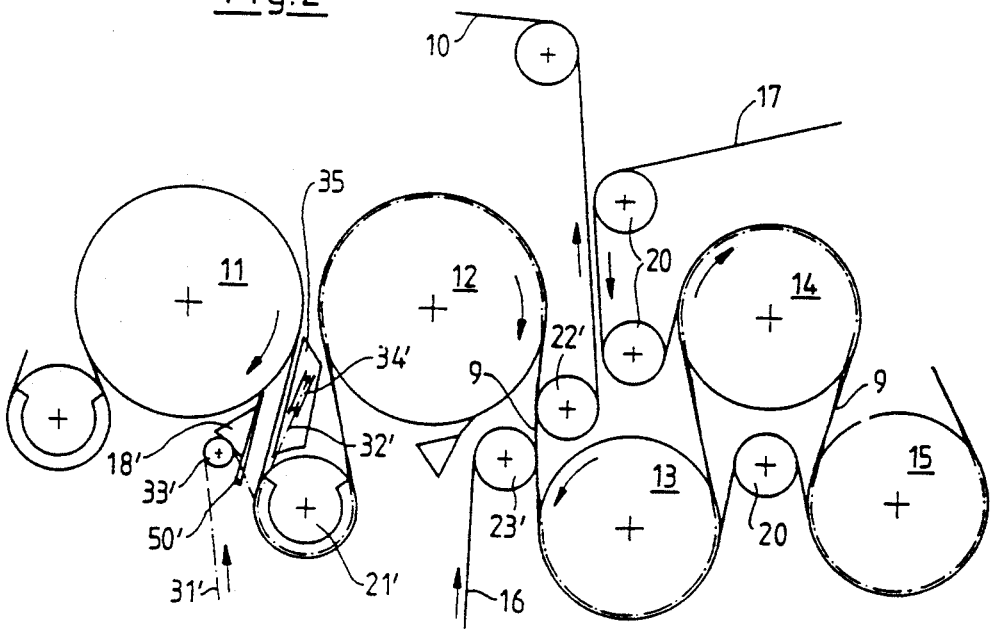

The embodiment shown in FIG. 2 differs from the embodiment of FIG. 1, because among other things, the horizontal distance between the cylinders 12 and 13 is substantially shorter. This has the advantage that the total length of the dry end of the paper making machine is accordingly shorter. Instead of the suction guide rolls 22, 23 (FIG. 1), normal guide rolls 22', 23'0 are provided. They are arranged so that the first open length of the web is present between these guide rolls. On the other hand, in FIG. 1 the first open length of web is located between the dryer cylinders 13 and 14 of the second dryer group. To this extent, the arrangement of the cylinders 12, 13 and guide rolls 22' and 23' shown in FIG. 2 corresponds to the prior art. According to the invention, a relatively long path of travel for the web 9 and the support belt 10 is provided between the next to the last dryer cylinder 11 here the selected dryer cylinder of the single wire dryer group and the following deflecting roll 21' here the selected deflecting roll. In addition, there is a scraper 18' with a guide plate 50'. On the circumference of the deflecting roll 21' there is a rope shears comprised of the ropes 31' and 32'. As compared with FIG. 1, therefore, the rope guide in FIG. 2 is extended a further distance into the single wire dryer group. The ropes 31', 32', guided by rope pulleys 33', 34', now extend over the dryer cylinder 12, and then directly from the cylinder 12 to the dryer cylinder 13 in the twin wire dryer group.

Figure 6:
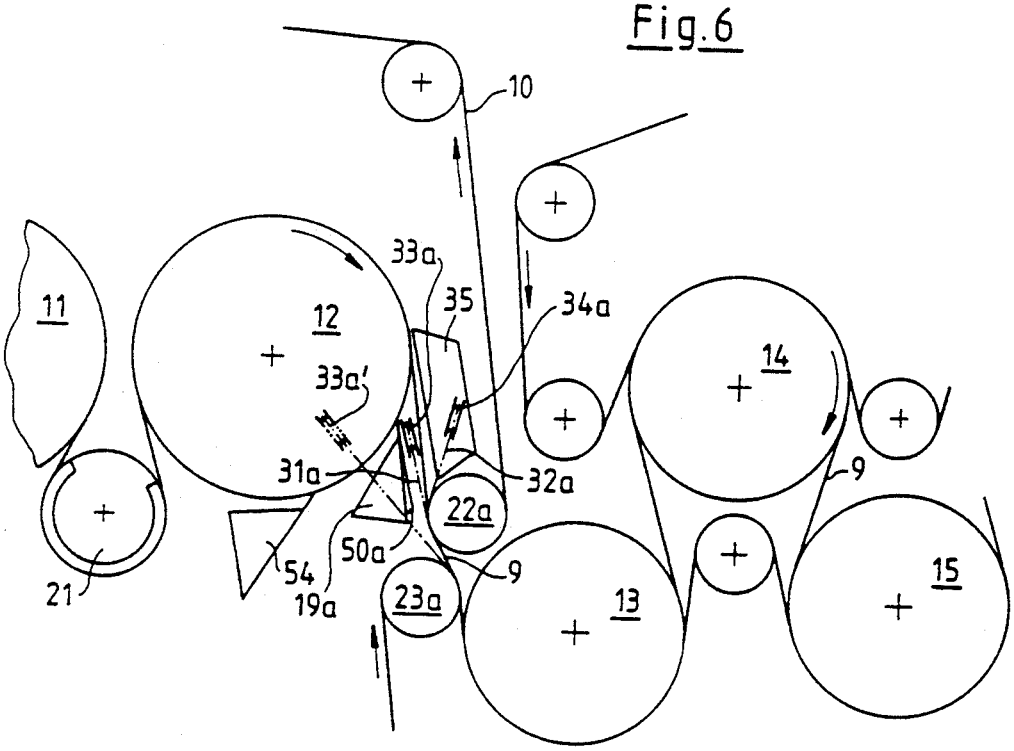

In FIG. 6, the horizontal distance between the two dryer cylinders 12 and 13 is somewhat greater than in FIG. 2 but less than in FIG. 1. The deflecting rolls 22*a* and 23*a*, which are developed as pure guide rolls, are arranged at the greatest possible distance from the dryer cylinder 12 and in such a manner that the web 9 wraps slightly around both deflecting rolls. The first open length of web, which in this case is very short, is again between these two rolls. Similar to the case of FIG. 1, a relatively long straight travel path is provided between the dryer cylinder 12 and the selected following deflecting roll 22*a* for the web 9 and the support belt 10. Opposite that path, is the scraper 19*a* with a guide plate 50*a*. Accordingly, the rope pulleys 33*a*, 34*a* are so arranged that the two ropes 31*a*, 32*a* form the rope shears on the circumference of the selected deflecting roll 22*a*. As an alternative, the rope shears could be arranged on the periphery of the first deflecting roll 23*a* of the twin wire dryer group in the manner that the rope pulley 33*a* is replaced by the rope pulley 33*a*' which is indicated by lines drawn with a dash and two dots.

Figure 5:
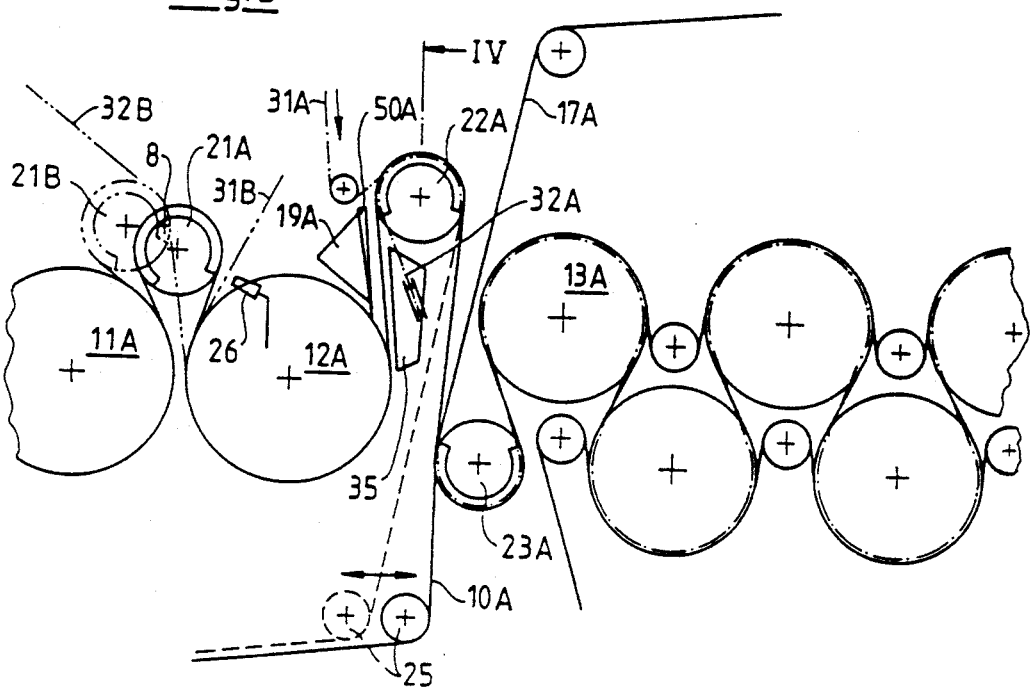
FIGS. 5 to 8 are respectively diagrammatic side views of other embodiments of the invention.

In FIG. 5, differing from the embodiments previously described, a single wire dryer group with bottom cylinders 11A, 12A and top deflecting rolls 21A, 22A is provided. Accordingly, the first dryer cylinder 13A of the twin wire dryer group is an upper row cylinder with which the upper support belt 17A is associated. Otherwise, the arrangement is substantially the same as in FIG. 1. Thus, the relatively long straight travel path of the support belt 10A (from the selected cylinder 12A to the selected deflecting roll 22A) is not from top to bottom but from bottom to top, and the rope shears formed by ropes 31A, 32A is arranged on the upper deflecting roll 22A.

The first deflecting roll 23A of the twin wire dryer group is again developed as a removal suction roll. In normal operation, that roll 23A contacts the support belt 10A of the single wire dryer group. However, the following guide roll 25 of the support belt 10A, or the removal suction roll 23A, can be displaced horizontally in such a manner that temporarily no contact takes place between the support belt 10A and the roll 23A. Use can be made of this possibility when the oncoming or leading tip of the edge strip is not to be brought initially as yet into the twin wire dryer group but is to extend into the cellar beneath the dryers. Alternatively, the edge strip can be brought at this place into the cellar should it in any way have torn in the twin wire dryer group. If the edge strip is now to be threaded or rethreaded into the twin wire dryer group, the edge strip is cut through in front of or before the rope shears, for instance on the deflecting roll 21A, by a water jet nozzle 26, which is movable transversely to the direction of travel of the web. This forms a new leading tip which is then grasped again by the scraper 19A and a guide plate 50A and is deflected laterally outward into the rope shears. At the same time, contact is also restored between the removal suction roll 23A, over which the upper support belt 17A of the twin wire dryer group travels, and the support belt 10A of the single wire dryer group. In a similar manner, it is also possible in FIGS. 1, 2 or 6 to have the edge strip, at the end of the single wire dryer group, first travel into the cellar and to then transfer it with a newly formed leading tip into the twin wire dryer group.

A further alternative is indicated in FIG. 5 by lines formed of a dash and two dots. The deflecting roll 21B is arranged asymmetrically between the dryer cylinders 11A and 12A so that a relatively long travel path is produced between the deflecting roll 21B and the following dryer cylinder 12A. The ropes 31B and 32B form the rope shears on the periphery of the selected dryer cylinder 12A. The deflecting roll 21B is provided merely in the region of the edge strip with a small blast zone 8 which is fed only temporarily with blast air in order to detach the tip of the edge strip from the support belt 10. Further guide means, not shown in the drawing, for instance, a guide plate, and/or additional blast nozzles then conduct the tip of the edge strip into the rope shears.

Figure 4:
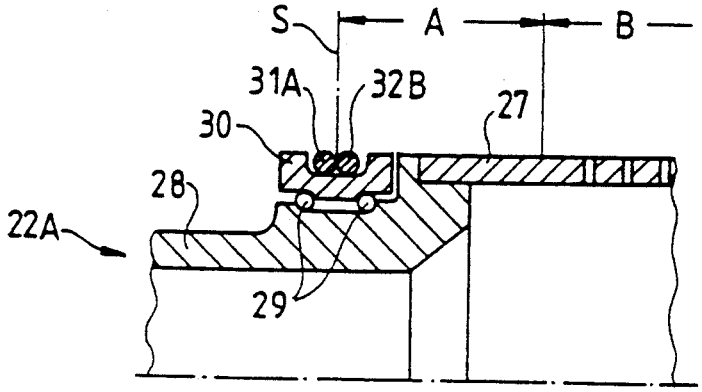
FIG. 4 is a partial longitudinal section through a deflecting roll with a rope guide ring rotatably mounted thereon.

The partial longitudinal section through a deflecting roll, for instance roll 22A in FIG. 4, shows that it has a perforated roll shell with a hollow roll journal on which a rope guide ring for the two ropes, for instance 31A, 32A, is turnably mounted, as symbolically indicated by two rollers 29. Such a "loose", i.e. turnably mounted rope ring, is necessary in FIG. 1 on the deflecting roll 22, in FIG. 2 on the deflecting roll 21' and on the dryer cylinder 12, in FIG. 5 on the deflecting roll 22A, in FIG. 6 on the deflecting roll **22*a*, in FIG. 7 on the deflecting roll 21B, and in FIG. 8 on the cylinder 13C. This takes into account that the speed of travel of the ropes 31, 32 is determined by the operating speed of the twin wire dryer group, and this may differ from the operating speed of the single wire dryer group. In FIG. 4**, the distance A between the rope plane S and the edge of the web width B is again shown.

Figure 7:
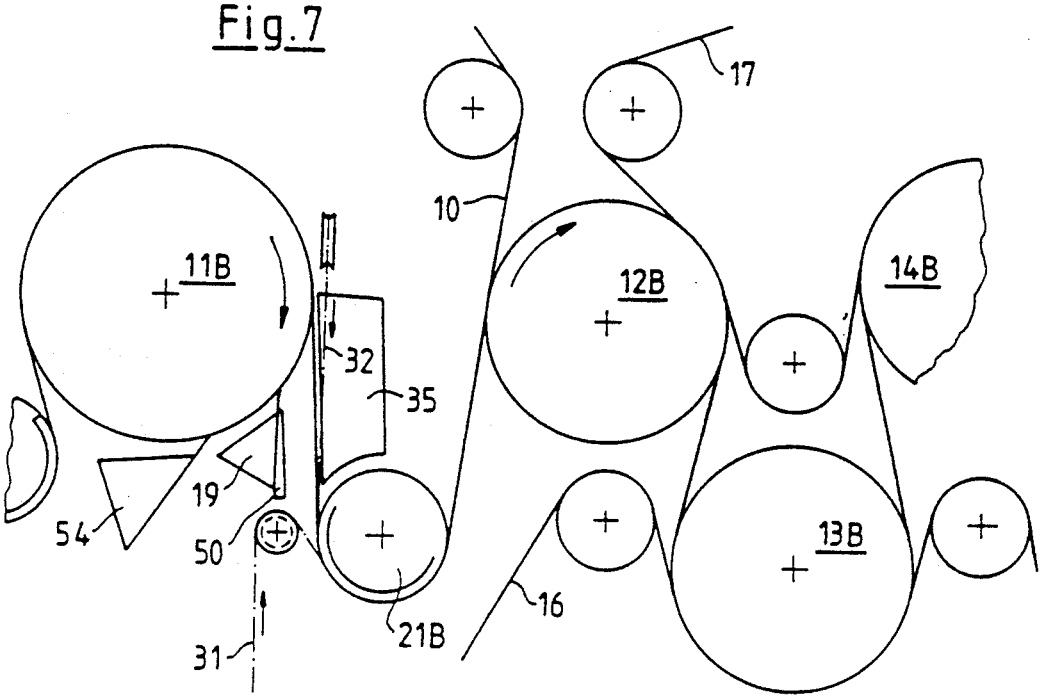

FIG. 7 differs from FIG. 2 substantially in that, instead of the previously shown last cylinder 12 of the single wire dryer group, an upper cylinder 12B is provided. Over this cylinder 12B there travel, one after the other and each with slight wrapping, first the support belt 10 of the single wire dryer group from which the cylinder 12B takes the paper web, and then the upper support belt 17 of the twin wire dryer group. The support belt 10 travels as previously over the selected dryer cylinder 11B and the selected deflecting roll 21B, between which there is again a long straight path of travel which, as previously, cooperates with scraper 19, guide plate 50 and guidance ropes 31, 32. Dryer cylinders 13B and 14B and the lower support belt 16 are parts of the twin wire dryer group.

Figure 8:
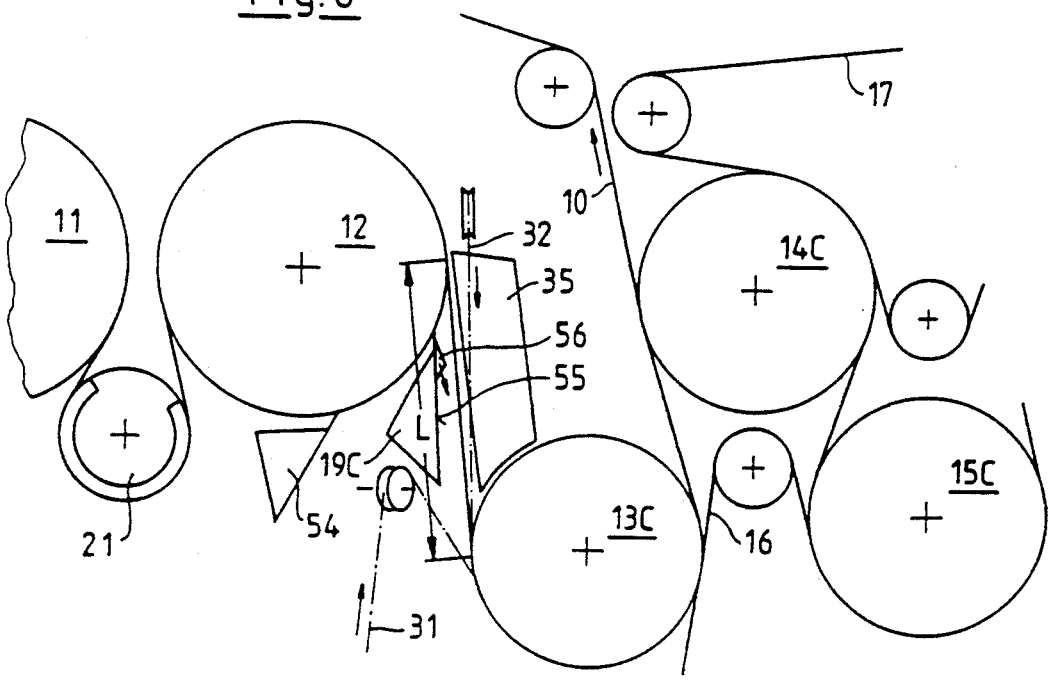

FIG. 8 differs from FIG. 6 substantially by the fact that the support belt 10 travels from the selected last dryer cylinder 12 of the single wire dryer group over the long straight travel path of length L, as previously provided, to the first lower dryer cylinder 13C of the twin wire dryer group. The support belt 10, together with the web of paper, then travels upward to the second dryer cylinder 14C of the twin wire dryer group, which takes the web off the support belt 10. The cylinder 13C at the same time serves as the selected last deflecting roll of the single wire dryer group. The two ropes 31 and 32 form the rope shears on it. The ropes travel there over a loose rope rim as described above. The cylinder 13C preferably has no drive of its own, i.e. it is driven indirectly via the support belt 10. Otherwise, the customary roll and cylinder drives are provided, for instance on the deflecting roll 21 and/or on the cylinder 12 as well as on the cylinders 14C and 15C. These drives have not been shown in the drawing. The cylinder 13C is only slightly wrapped by the lower support belt 16. However, a larger angle of wrapping can also be provided. There are again provided on the selected cylinder 12 a short edge strip scraper 19C and an additional scraper 54 which extends over the entire width of the web. The following elements are provided on the edge strip scraper 19C instead of a separate guide plate 50. The outer surface 55 of the scraper body, which surface faces the support belt 10, assumes the function of the guide plate and therefore extends substantially parallel to the path of travel of the support belt 10. For deflecting the edge strip into the rope shears which is formed by the ropes 31 and 32, at least one blast nozzle 56 is provided.

For the normal operation of the dry end, a web stabilizer 35 is arranged in FIGS. 1, 2 and 5 to 8 in each case on the relatively long travel path which serves for the lateral deflection of the edge strip. The stabilizer holds the web 9 firmly on the support belt 10 or 10A while the leading tip of the edge strip of the web is deflected to the rope guide.

Although the present invention has been described in relation to particular embodiments thereof, many other variations and modifications and other uses will become apparent to those skilled in the art. It is preferred, therefore, that the present invention be limited not by the specific disclosure herein, but only by the appended claims.

What is claimed is:

1. Means for threading a paper web in a dryer group in the dry end of a paper making machine, wherein the paper web having a first web width, an edge strip along a lateral edge of the web and a leading tip on the edge strip;

the dry end comprising: a single wire dryer group being followed by a twin wire dryer group in the path of the web through the dry end;

the single wire dryer group having a plurality of first dryer cylinders and a respective first deflecting roll between neighboring ones of the first dryer cylinders in the single wire dryer group, a first support belt for the web, the belt passing alternately from a first dryer cylinder in the single wire dryer group, over a first deflecting roll, and then over the neighboring first dryer cylinder in the path of the web through the single wire dryer group; the first support belt supporting the web so as to press the web against the first dryer cylinders and so that the first support belt itself comes into contact with the first deflecting rolls; the single wire dryer group having an end for the web path toward the twin wire dryer group; toward its end, the single wire dryer group having a selected first dryer cylinder and a respective selected first deflecting roll following the selected first dryer cylinder in the path of the web;

the twin wire dryer group having a second row of second dryer cylinders and having a third row of third dryer cylinders, the web passing in a meander path alternately over the second and third dryer cylinders through the twin wire dryer group;

the second row of dryer cylinders having a respective second support belt for the web, and second means guiding the second support belt to pass over the second dryer cylinders but not over the third dryer cylinders; the third row of dryer cylinders having a respective third support belt for the web and third means guiding the third support belt to pass over the third dryer cylinders but not over the second dryer cylinders, whereby the web has an open unsupported length of travel between each neighboring second and third dryer cylinder on the meander path of the web;

a device for threading the edge strip of the web, leading tip first, into the dry end, and that device comprising:

a rope guide comprising two ropes for sandwiching the leading tip of the edge strip between the ropes, the two ropes traveling through the twin wire dryer group in the same meander path as and traveling with the web for guiding the leading tip of the edge strip along the meander path through the second dryer group;

the rope guide for the twin wire dryer group beginning toward the end of the single wire dryer group; in the single wire dryer group, there is a relatively long straight path of travel for the web and the support belt between the selected first dryer cylinder and the selected first deflecting roll following the selected first dryer cylinder in the path of the web and the support belt through the single wire dryer group;

means toward the beginning of the rope guide for causing the ropes to converge toward each other to define rope shears where the two ropes of the rope guide can first engage and guide the leading tip of the edge strip of the web; the rope guide, including the rope shears thereof, being laterally outside the width of the web the rope shears being generally in the region of the periphery of the selected deflecting roll;

means for deflecting the leading end of the edge strip of the web laterally out of the web width and into the rope shears, the deflecting means being located upstream in the path of the web from the rope shears and along the long straight path of travel of the web.

2. The device of claim 1, wherein the selected first dryer cylinder comprises one of the last one of the first dryer cylinders and the next to last one of the first dryer cylinders.

3. The device of claim 1, wherein the deflecting means comprises a guide plate generally at the long straight path of the travel of the support belt and shaped for deflecting the leading tip of the edge strip out of the region of the web width and into the rope shears.

4. The device of claim 3, wherein the guide plate extends approximately parallel to the straight path of travel and is spaced at a relatively short distance from the straight path of travel.

5. The device of claim 4, wherein the deflecting means further comprises a scraper at the selected first dryer cylinder for deflecting the leading tip of the edge strip off the selected first dryer cylinder.

6. The device of claim 5, wherein both the scraper and the guide plate extend transversely of the web only over the edge region of the web width in which the edge strip is formed.

7. The device of claim 6, wherein following the scraper in the direction of travel of the web, an additional scraper extends over the entire web width and on the selected first dryer cylinder at which the first of the scrapers is disposed.

8. The device of claim 3, wherein the guide plate extends in the direction of travel of the first support belt into the region of the rope shears.

9. The device of claim 3, further comprising air blast means in the guide plate directed to blast air obliquely to the direction of travel of the web outward toward the rope shears and being selectively operable during the threading of the web.

10. The device of claim 1, wherein the rope shears is arranged on the periphery of the selected deflecting roll.

11. The device of claim 1, wherein the rope shears is arranged a short distance after the selected deflecting roll in the path of the web.

12. The device of claim 1, wherein the selected dryer cylinder is the next to last of the first dryer cylinders in the single wire dryer group and the selected deflecting roll is between the next to last and the last of the first dryer cylinders in the single wire dryer group.

13. The device of claim 1, further comprising means for holding the edge strip fast to the support belt along the path around the first deflecting rolls in the single wire dryer group.

14. The device of claim 1, wherein the length of the straight path of travel of the support belt is in the range of two to ten times the lateral distance of the rope guide from the adjacent edge of the web width.

15. The device of claim 1, wherein the length of the straight path of travel of the support belt is in the range of three to six times the lateral distance of the rope guide from the adjacent edge of the web width.

16. The device of claim 1, further comprising a web stabilizer for stabilizing the web on the support belt and located along the straight path of travel of the support belt.

17. The device of claim 1, further comprising means for cutting the web edge strip, the cutting means being located in the single wire dryer group upstream of the straight path travel of the support belt.

18. The device of claim 1, wherein the selected deflecting roll is a suction roll.

19. The device of claim 1, wherein the selected dryer cylinder is the last of the first dryer cylinders in the single wire dryer group and the selected deflecting roll follows the last first dryer cylinder.

20. The device of claim 19, wherein the selected deflecting roll is the last deflecting roll of the single wire dryer group following the last of the first dryer cylinders of the single wire dryer group.

21. The device of claim 20, further comprising a support belt guide roll arranged before the first dryer cylinder of the second row of dryer cylinders of the twin wire dryer group, and the support belt guide roll serves as a web removing roll, which is normally in contact with the first support belt of the single wire dryer group for removing the web from the first support belt.

22. The device of claim 21, wherein the support belt of the single wire dryer group has the straight path of travel extending essentially upward, the last deflecting roll of the single wire dryer group being above the straight path of travel, the web removing roll of the twin wire dryer group being past the last deflecting roll of the single wire dryer group and being downward from the last deflecting roll; the support belt of the single wire dryer group passing the last deflecting roll of the single wire dryer group and then passing the web removing roll, where the web is transferred from the first support belt of the single wire dryer group to the web removing roll of the second dryer group.

23. The device of claim 22, further comprising means for temporarily adjusting the distance between the first support belt of the single wire dryer group and the web removing roll, for enabling the web to pass the web removing roll without the web transferring to the removing roll.

24. The device of claim 23, wherein the means for enabling the temporary adjustment of the distance between the first support belt and the web removing roll comprises means for laterally displacing one of the web removing roll and the first support belt with respect to the other.

25. The device of claim 1, wherein the ropes of the rope guide travel over at least one deflection roll and one dryer cylinder of the single wire dryer group and then over alternating ones of the second and third dryer cylinders; the rolls and first dryer cylinders in the first dryer group over which the ropes travel include independently rotatable rope guides over which the ropes travel so that the ropes can travel at a different rate than the rate of rotation of the rolls and the first dryer cylinders of the single wire dryer group.

26. The device of claim 1, wherein the one deflecting roll which follows the straight path of travel comprises a normal guide roll.

27. The device of claim 26, wherein there is an open length of the web path between the one deflecting roll and the first roll of the twin wire dryer group in the web path.

* * * * *